US005237154A

United States Patent [19]

Pellhammer et al.

[11] Patent Number: 5,237,154

[45] Date of Patent: Aug. 17, 1993

[54] PROCESS FOR MANUFACTURING A SLOTTED HOLE SCREEN

[75] Inventors: Maurus Pellhammer, Ravensburg; Wolfgang Ehmcke, Ravensburg-Oberhofen, both of Fed. Rep. of Germany

[73] Assignee: Sulzer-Escher Wyss GmbH, Ravensburg, Fed. Rep. of Germany

[21] Appl. No.: 623,512

[22] Filed: Dec. 7, 1990

[30] Foreign Application Priority Data

Dec. 9, 1989 [DE] Fed. Rep. of Germany ..... 3940718

[51] Int. Cl.[5] ..... B23K 9/00

[52] U.S. Cl. ..... 219/137 R; 29/163.6; 219/58

[58] Field of Search ..... 219/137 R, 56, 58; 29/163.6

[56] References Cited

U.S. PATENT DOCUMENTS 3,370,150 2/1968 Nordgren ..... 219/56
4,221,319 9/1980 Paice ..... 219/56
4,221,951 9/1980 Connolly ..... 219/56

FOREIGN PATENT DOCUMENTS 1760694 3/1971 Fed. Rep. of Germany .
2258906 6/1973 Fed. Rep. of Germany .
8910605 9/1989 Fed. Rep. of Germany .

*Primary Examiner*—Clifford C. Shaw
*Attorney, Agent, or Firm*—Wolf, Greenfield & Sacks

[57] ABSTRACT

A process for manufacturing a slotted hole screen made by mechanically joining a plurality of longitudinal members to a plurality of cross bars reduces joint roughness, burrs and recesses by including a step of covering the joints with a covering material which has a smooth exterior surface. The covering material is liquefied and has sufficient surface tension to form the smooth surface. In an alternative embodiment, the joints in a slotted screen formed by welding a plurality of longitudinal members to a plurality of cross bars are smoothed by selectively remelting the joints to form the smooth exterior.

20 Claims, 3 Drawing Sheets

Fig.1
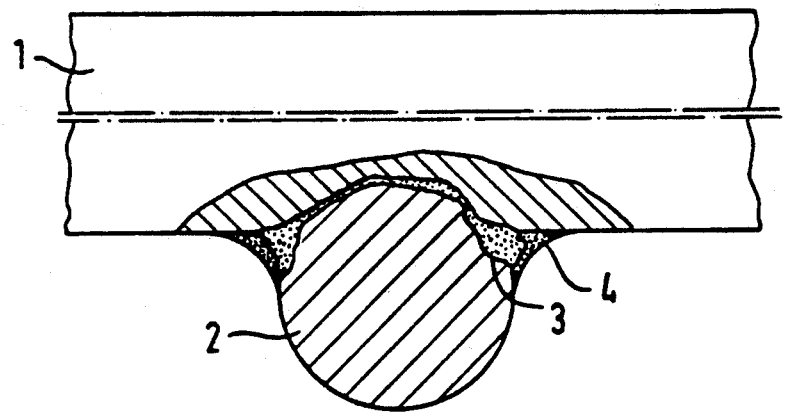
Fig. 2 *(PRIOR ART)*
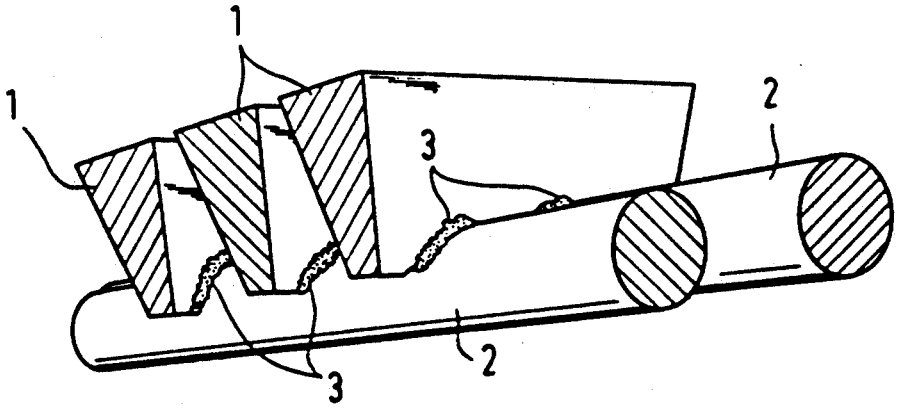
Fig.3
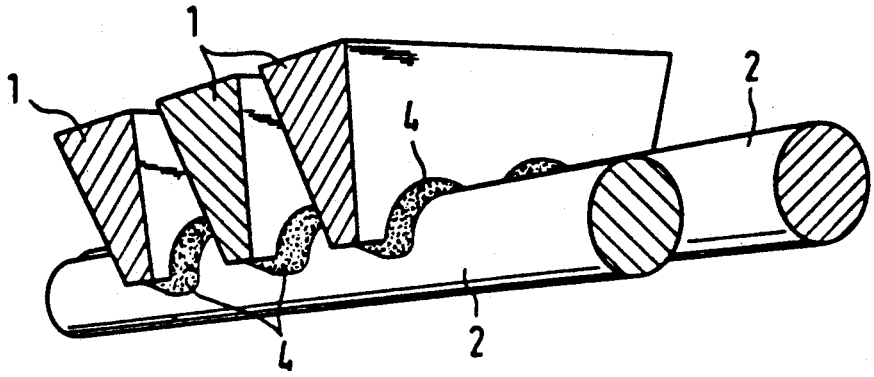

PROCESS FOR MANUFACTURING A SLOTTED HOLE SCREEN

FIELD OF THE INVENTION

This invention relates to a process for manufacturing slotted hole screens which are particularly suited for use in devices for separating or cleaning aqueous fiber suspensions, for example in paper manufacturing.

BACKGROUND OF THE INVENTION

In paper manufacture, there are various steps which require the treatment of aqueous solutions for example to remove or align fibers in the solution. This treatment is generally carried out by means of slotted hole screens in which wire-shaped or bar-shaped longitudinal members that define the screen slots are mounted on cross bars. Slotted hole screens in general also include so called slit screens that have shorter slot lengths or discontinuous slots. The screens are used in different forms, for example as cylindrical screen baskets, flat screens, curved screens, half shell screens, drum screens or the like.

Such screens are used in sorters, reject sorters and so-called fractionators. The sorters serve to remove impurity materials, such as contaminant particles, from aqueous fiber suspensions which, in this phase of treatment, have an approximately 0.5 to 4% fiber content and about 96 to 99.5% water content, while the fractionators serve to separate two fractions having fibers of different lengths from one another and to hold back the longer fibers at the screen and remove them separately. The screens are also used in reject sorters and drum screens which operate on a material consistency of up to 20%.

In known manufacturing processes of such slotted hole screens, the longitudinal members and the cross bars are joined by means of welding or by wrapping them around each other. A common welding process which is used is the known so called resistance welding in which an electrical current creates a heat of fusion at the contact points between the longitudinal members and the cross bars to physically join the two pieces. In principle, however, other welding processes are also suitable. The welding process has the disadvantage that the screens made in this manner have undesirable burr formations as well as an undesirable roughness, recesses, gaps or bumps in the welded joints.

In the case of wrapped joints in which the longitudinal members are wrapped around the cross bars, undesirable recesses and edges are formed in the joints. During use of these screens, fibers from the fiber suspension can be caught in the joints, which results in the danger that further fibers attach themselves to the caught fibers and form cohesive flocks, webs or plaits. When flocks, webs or plaits formed in this way release themselves from the screen after a certain period of operation of the slotted hole screen and these are flushed into the flow of material behind the screen, the desired sorting effect or fractionating effect of the screen is no longer assured. This is extremely disadvantageous in paper manufacture, in which it is important that the paper fibers in the fiber suspension are separated to the maximum extent before they are applied onto the water extracting screen, and it is also important that no coherent flocks or webs are formed which considerably worsen the quality of the paper to be produced and can lead to interruptions in production. Blockages of the sorting screen can also arise.

It is, therefore, an object of the invention to provide a process for manufacturing slotted hole screens in which the screen joints are formed in such in such a manner that the danger of the catching paper fibers, and thus of forming flocks and/or webs of fibers as well as the blocking of the screen is entirely or substantially reduced.

It is another object of the invention to provide a process for manufacturing slotted hole screens in which the strength of the joint locations is increased.

SUMMARY OF THE INVENTION

The foregoing objects are achieved and the foregoing problems are solved in accordance with the invention in which the joints between the longitudinal members and the cross bars of the slotted hole screen are formed during manufacture in such a manner that the joint surfaces are covered with a smooth, solidified material. More particularly, the Joints are smoothly rounded off or covered with materials which form smooth, concave molded shapes on their surfaces. A variety of materials, including solder and welding materials, can be applied as coverings to the joints provided that the materials have sufficient surface tension so that they form a smooth and possibly rounded covering over the joint surface. By selecting a covering material which flows at a relatively low temperature in comparison to the melting temperature of the joint material and the bars and longitudinal members, a further advantage is gained. The relatively low temperature required to form the joint covering carries only a small risk of distorting the slotted hole screen and softening or melting the existing joints.

In an alternative manufacturing process, hardened joint material is remelted after the initial welding process has been completed, for example, in an inert gas atmosphere (so-called TIG welding) to produce the smooth exterior join surfaces.

The slotted hole screen manufactured in accordance with the invention has the advantage that the joint strength is increased (for example, through reduction of the notch effect) which is of particular significance on account of the varying loads arising during operation.

BRIEF DESCRIPTION OF THE DRAWING

The process for manufacture is explained in accordance with the drawings, in which:

FIG. 1 is a cross sectional view taken through an inventively covered welded screen joint;

FIG. 2 is a partial oblique view of prior art screen with welded joints showing the rough joint exterior;

FIG. 3 is a partial oblique view of a screen with a covered weld joints;

DETAILED DESCRIPTION OF THE PREFERRED EMBODIMENTS

Figure 4:
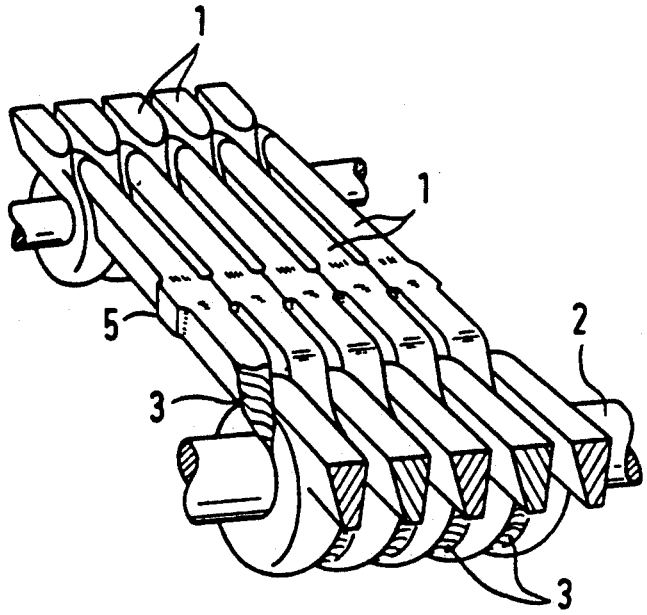
FIG. 4 is a partial oblique view of a prior art screen with a wrapped joint which is not covered.

A prior art slotted screen shown in FIG. 2 of the drawing comprises longitudinal members 1 formed out of wedge shaped sectional bars. The longitudinal members define the slots of the slotted screen and are held apart at predetermined spacings by a plurality of cross bars which are arranged perpendicularly to the longitudinal members. The cross bars are also positioned at predetermined spacings and have, illustratively, a round cross section. At the contact points between the longitudinal members and the cross bars, the two elements are mechanically attached to each other, for example, by welding. Typically, the welded joints 3 between the sectional bars 1 and the cross bars 2 have irregular and uneven surfaces in the prior art unfinished condition.

A slotted hole screen formed in accordance with the inventive process, which is described in more detail below, is respectively shown in FIGS. 1 and 3 in a cross sectional and oblique view, respectively. In particular, in the inventive process, an additional construction step is provided in which a covering 4 comprised of solder or another smoothly flowing, solidifying material, is applied over the exposed joint. The covering material, which is applied in a fluid state and thereafter solidifies, has a smooth exterior surface on account of the high surface tension of the covering material in the fluid state. The covered joint surfaces are particularly smoothly rounded off in the regions of their contact with the peripheral surface of the cross bars 2 and form a concave exterior surface. Suitable covering materials might, illustratively be solder with a relatively low melting point, thermosetting or thermoplastic plastic materials.

As shown in FIG. 1, in order to prevent the covering material from affecting the screen operation or performance, it is important that covering 4 be applied only in the joint vicinity. Restriction of covering 4 to the joint vicinity can be accomplished in several ways. For example, the covering material can be applied in powder or paste form directly to the joint location. Subsequently, the covering can be liquefied by heating or treating it with solvents so that the covering material becomes fluid. As mentioned before, the covering material is selected to have sufficient surface tension so that, once it becomes fluid, it forms the desired concave, smooth exterior surface illustrated in FIG. 1.

Alternatively, the covering 4 can be applied by dipping the screen in a fluid covering material. In this case, it is necessary to perform a preparatory step to prevent the entire screen from beinq coated. Illustratively, the screen can be pre-treated with a repellant material prior to dipping in the covering material. The repellant material can be applied to the screen pieces except in the area of the joint or the repellant material can be applied over the entire screen and then subsequently removed from the joint area. When the pre treated screen is dipped into the covering material, the repellant material helps the surface tension of the covering material form the desired smooth joint exterior.

After the covering 4 has been applied and allowed to form a suitable smooth surface, it is hardened to form the final joint covering. This may be done by simply allowing any solvent in the fluid covering material to evaporate or allowing a heated covering material to cool. In some cases, an additional heat treating step may be necessary.

FIG. 4 shows a section of a prior art slotted screen with joints fabricated by wrapping longitudinal members 1 around cross bars 2. In this process of manufacture, spacing locations 5 on the longitudinal elements precisely separate bars 1 from the respective adjoining bars in order to accurately define the slot width. In this prior art construction, the wrapped joints 3 have the same disadvantages with regard to the operation of the screen as has already been described with respect to the welded joints.

Figure 5:
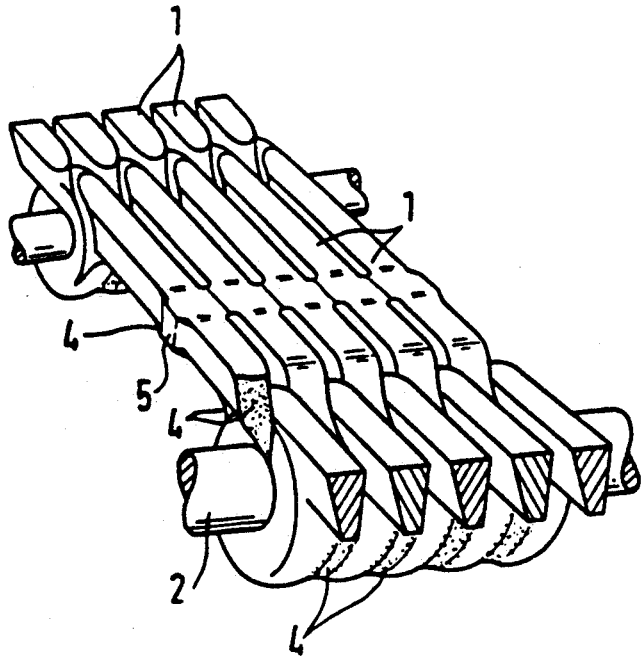
FIG. 5 is a partial oblique view of a screen with a wrapped joint which is covered in accordance with the inventive process.

FIG. 5 shows a slotted screen constructed in accordance with the inventive process. As with the previously-described process, an additional process step is added to the prior art process in which a covering material 4 is applied over the disadvantageous hollow spaces in the joints to cover over the edges and burrs.

Figure 6:
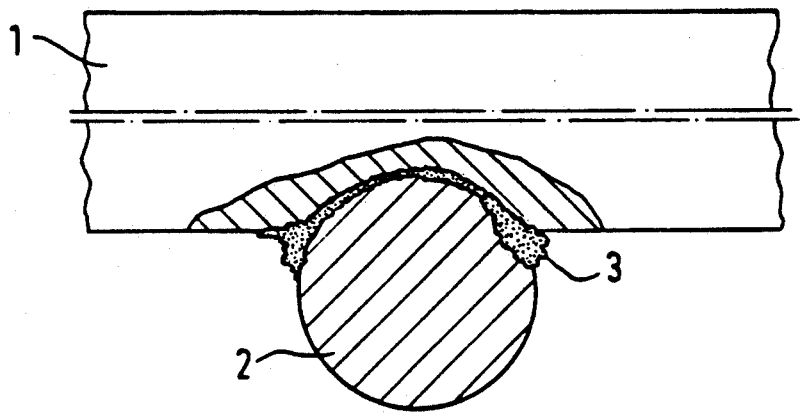
FIG. 6 is a cross sectional view through a prior art welded joint which is not covered.
Figure 7:
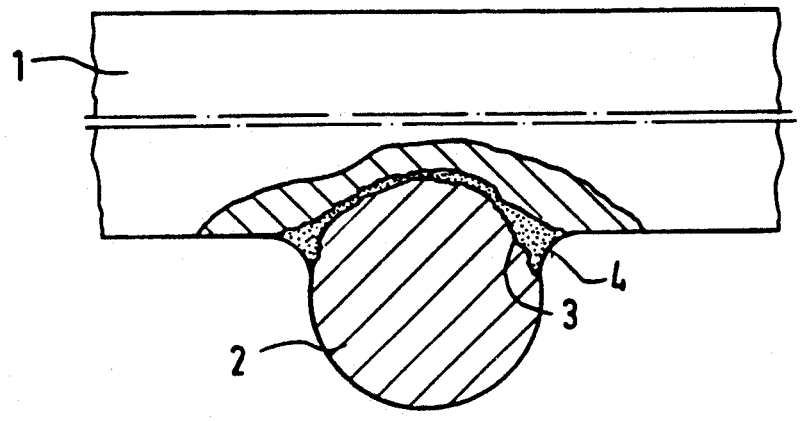
FIG. 7 is a cross sectional view through an inventive welded joint which has been remelted in accordance with the invention to form a smooth join exterior.

FIGS. 6 and 7 illustrate a second embodiment of the invention. FIG. 6 shows a cross-sectional view of a prior art welded screen joint. In particular, this figure illustrates the rough exterior and burrs typically formed on the joint surface from the welding process. In accordance with the invention, after the joint 3 has been formed by welding, the joint can be subjected to an additional process step in which the joint material is remelted in an inert gas atmosphere. The remelting can be performed, for example, by placing the completed screen in a heated atmosphere which is held at a temperature sufficient to soften the joint material for a time period which is less than the time necessary to completely separate the joint. Alternatively, the completed screen can be placed in an inert atmosphere or an inert gas can be blown over the screen and an electric arc can be formed in the vicinity of the joints. This latter process is a convention welding technique known as TIG welding. Again, the time period during which the arc is applied is sufficient to meld completely separate the joint.

As the joint material melts from the outside towards the inside, the welding material will have sufficient surface tension so that it forms the desired smooth exterior when the material becomes fluid. The result is the remelted joint shown in FIG. 7 in which the joint material 3 has melted to form a smooth exterior surface 4.

What is claimed is:

1. In a process for manufacturing a slotted hole screen in which elongated longitudinal members which define screen slots are mechanically joined to cross bars by at least one of wrapping the longitudinal members around the cross bars and welding the longitudinal members to the cross bars to form a plurality of joints, the improvement comprising the steps of:

A. covering said joints with a smoothly-flowing fluid material; and

B. solidifying the fluid material so that said joints are provided with a covering having a smooth exterior surface that covers surface imperfections and holes produced by mechanically joining the longitudinal members to the cross bars.

2. In a process for manufacturing a slotted hole screen, the improvement according to claim 1, wherein in step B said covering is formed with a concave molded exterior shape.

3. In a process for manufacturing a slotted hole screen, the improvement according to claim 1, wherein step A comprises covering said joints with a fluid material which has sufficient surface tension to cling to said joints.

4. In a process for manufacturing a slotted hole screen, the improvement according to claim 1, wherein step A comprises covering said joints with solder, a thermosetting plastic material or a thermoplastic plastic material.

5. In a process for manufacturing a slotted hole screen, the improvement according to claim 1, wherein step A comprises the steps of:

A1. applying a powdered material to said joints; and

A2. liquefying said powdered material to form said smoothly-flowing fluid material.

6. In a process for manufacturing a slotted hole screen, the improvement according to claim 1, wherein step A comprises the steps of:

A3. applying a paste material to said joints; and

A4. liquefying said paste material to form said smoothly-flowing fluid material.

7. In a process for manufacturing a slotted hole screen in which elongated longitudinal members which define screen slots are mechanically jointed to cross bars to form a plurality of joints, the improvement comprising the steps of:

A. covering said joints with a smoothly-flowing fluid material including:

A5. covering said elongated longitudinal members and said cross bars with a masking material which repels said smoothly-flowing fluid material;

A6. removing said masking material from said joints; and

A7. applying said smoothly-flowing fluid material to said joints by dipping said screen in said smoothly-flowing fluid material, said masking material preventing said smoothly-flowing fluid material from covering said elongated longitudinal members and said cross bars; and B. solidifying the fluid material so that said joints are provided with a covering having a smooth exterior surface.

8. A process for manufacturing a slotted hole screen comprising the steps of:

A. positioning a plurality of elongated longitudinal members parallel to each other to define screen slots;

B. positioning a plurality of cross bars perpendicular to, and touching, said elongated longitudinal members to form a plurality of contact points between said elongated longitudinal members and said cross bars;

C. permanently mechanically joining said elongated longitudinal members to cross bars at said contact points to form a plurality of joints;

D. covering subsequent to mechanically joining said joints with a smoothly-flowing fluid material; and E. solidifying the fluid material so that said joints are provided with a covering having a smooth exterior surface that fills any rough portions and holes in the joints formed during the step of mechanically joining.

9. A process to claim 8 wherein step C comprises the step of:

C1 welding said elongated longitudinal members to said cross bars at said contact points.

10. A process for manufacturing a slotted hole screen comprising the steps of:

A. positioning a plurality of elongated longitudinal members parallel to each to define screen slots;

B. positioning a plurality of cross bars perpendicular to, and touching, said elongated longitudinal members to form a plurality of contact points between said elongated longitudinal members and said cross bars;

C. mechanically joining said elongated longitudinal members to cross bars at said contact points to form a plurality of joints, the step of mechanically joining further including:

C2. wrapping said elongated longitudinal members around said cross bars; and

D. covering said joints with a smoothly-flowing fluid material; and

E. solidifying the fluid material so that said joints are provided with a covering having a smooth exterior surface.

11. A process according to claim 8, wherein in step E said covering is formed with a concave molded exterior shape.

12. A process according to claim 8, wherein step D comprises covering said joints with a fluid material which has sufficient surface tension to cling to said joints.

13. A process according to claim 8, wherein step D comprises covering said joints with solder, a thermosetting plastic material or a thermoplastic plastic material.

14. A process according to claim 8, wherein step D comprises the steps of:

D1. applyinq a powdered material to said Joints; and

D2. liquefying said powdered material to form said smoothly flowing fluid material.

15. A process according to claim 8, wherein step D comprises the steps of:

D3. applying a paste material to said joints: and

D4. liquefying said paste material to form said smoothly flowing fluid material.

16. A process for manufacturing a slotted hole screen comprising the steps of:

A. positioning a plurality of elongated longitudinal members parallel to each other to define screen slots;

B. positioning a plurality of cross bars perpendicular to, and touching, said elongated longitudinal members to form a plurality of contact points between said elongated longitudinal members and said cross bars;

C. mechanically joining said elongated longitudinal members to cross bars at said contact points to form a plurality of joints;

D. covering said joints with a smoothly-flowing fluid material the step of covering further comprising the steps of:

D5. covering said elongated longitudinal members and said cross bars with a masking material which repels said smoothly flowing fluid material;

D6. removing said masking material from said joints; and

D7. applying said smoothly flowing fluid material to said joints by dipping said screen in said smoothly flowing fluid material, said masking material preventing said smoothly-flowing fluid material from covering said elongated longitudinal members and said cross bars; and E. solidifying the fluid material so that said joints are provided with a covering having a smooth exterior surface.

17. In a process for manufacturing a slotted hole screen in which elongated longitudinal members which define screen slots are welded to cross bars to form a plurality of weld joints comprised of weld joint material, the improvement comprising the steps of:

A. reheating said weld joints for a time duration sufficient to remelt said weld joint material so that said weld joint material forms a smooth exterior surface.

18. In a process for manufacturing a slotted hole screen, the improvement according to claim 17, wherein step A comprises the steps of:

A1. surrounding said weld joints in an inert atmosphere; and

A2. creating an electric arc in the direct vicinity of said weld joints, said arc creating heat to remelt said weld joint material.

19. In a process for manufacturing a slotted hole screen, according to claim 18, wherein the inert atmosphere comprises an inert welding gas atmosphere.

20. A process for manufacturing a slotted hole screen comprising the steps of:

A. positioning a plurality of elongated longitudinal members parallel to each other to define screen slots;

B. positioning a plurality of cross bars perpendicular to, and touching, said elongated longitudinal members to form a plurality of contact points between said elongated longitudinal members and said cross bars;

C. welding said elongated longitudinal members to said cross bars at said contact point to form a plurality of welded joints;

D. melting, subsequent to welding, the weld joints so that the surface of the joints flows to form a smooth surface; and E. solidifying the melted weld joints so that said joints are provided with a smooth exterior surface that is smoother than a surface obtained in the step of welding.

* * * * *